United States Patent [19]

Abom

[11] 4,196,594

[45] Apr. 8, 1980

[54] PROCESS FOR THE RECOVERY OF MECHANICAL WORK IN A HEAT ENGINE AND ENGINE FOR CARRYING OUT THE PROCESS

[76] Inventor: Jan V. Åbom, 12 Popplegatan, Västra Frölunda, Sweden, S-421 74

[21] Appl. No.: 851,560

[22] Filed: Nov. 14, 1977

[51] Int. Cl.[2] ..... F01K 21/04; F01K 25/06

[52] U.S. Cl. ..... 60/649; 60/509; 60/673

[58] Field of Search ..... 60/649, 673, 674, 509

[56] References Cited

U.S. PATENT DOCUMENTS

| | | | |
|---|---|---|---|
| 1,219,970 | 3/1917 | Lowenstein | 60/649 |
| 3,972,195 | 8/1976 | Hays et al. | 60/649 X |
| 4,041,708 | 8/1977 | Wolff | 60/673 X |

*Primary Examiner*—Allen M. Ostrager
*Attorney, Agent, or Firm*—Karl W. Flocks

[57] ABSTRACT

In a process for recovering mechanical work in a heat engine there is used as a working medium in the heat engine a gas to which vapor is added having a H-value lower than the H-value of the gas, the gas being caused to absorb the condensation heat from the vapor by condensation of the vapor under essentially isothermal expansion. A heat engine for carrying out the process comprises; an isothermal compressor to which a liquid injection mechanism is connected; an isentropic compressor; an expansion machine to which a vapor generator is connected; and at least one additional expansion machine with liquid separator; said compressors and expansion machines being included in a closed circulation system for the gas serving as a working medium.

9 Claims, 2 Drawing Figures

P
bar 100
3
4a
4b
4c
4d
4e
6
2
1
1
Vm³

PROCESS FOR THE RECOVERY OF MECHANICAL WORK IN A HEAT ENGINE AND ENGINE FOR CARRYING OUT THE PROCESS

The present invention relates to a process for the recovery of mechanical work in a heat engine. The new and characteristic feature of the process is that the working medium used in the heat engine is a gas to which vapour is added having a H-value lower than the H-value of the gas, said gas being caused to absorb the condensation heat from the vapour by condensation of the vapour under essentially isothermal expansion. In this connection, H is $=Cp/Cv$, where Cp is the specific heat at constant pressure and Cv is the specific value at constant volume. As a working medium in the heat engine use is advantageously made of rare gas (monatomic), such as argon or helium $H \approx 1.66$, while the vapour may be aqueous steam with $H \approx 1.30$. The vapour may also advantageously be zinc vapour or cadmium vapour. This will give a still better result because $H \approx 1$ and the boiling-point is higher, which results in the total pressure of the process being low.

Through the process of the present invention the engine can give a thermal efficiency of about 75%, at moderate pressures, i.e. approximately $\frac{3}{4}$ of the heat supplied will be theoretically transformed into mechanical work. This is to be compared with the Stirling, Diesel and vapour processes which will give a thermal efficiency of approximately 37% when applying the Carnot process.

The process of the invention is primarily intended to be carried out in a compression and expansion engine in which the vapour is supplied after the compression phase but before or during the expansion phase. The compression of the gas in the engine is performed in at least two steps, the first step being essentially isothermal and the latter step being essentially isentropic. The expansion of the gas in the engine is also carried out in at least two steps, the first step being essentially isothermal and the latter essentially isentropic.

The invention also relates to an engine for carrying out the process stated above, said engine being characterized in that it comprises; an isothermal compressor to which there is connected a liquid injection mechanism or the like; an isentropic compressor; an expansion machine to which there is connected a vapour generator; and at least one additional expansion machine with liquid separator for the condensed vapour; said compressors and expansion machines being included in a closed circulation system for the gas.

The invention will be described more in detail hereinafter with reference to the accompanying drawings, in which.

Figure 1:
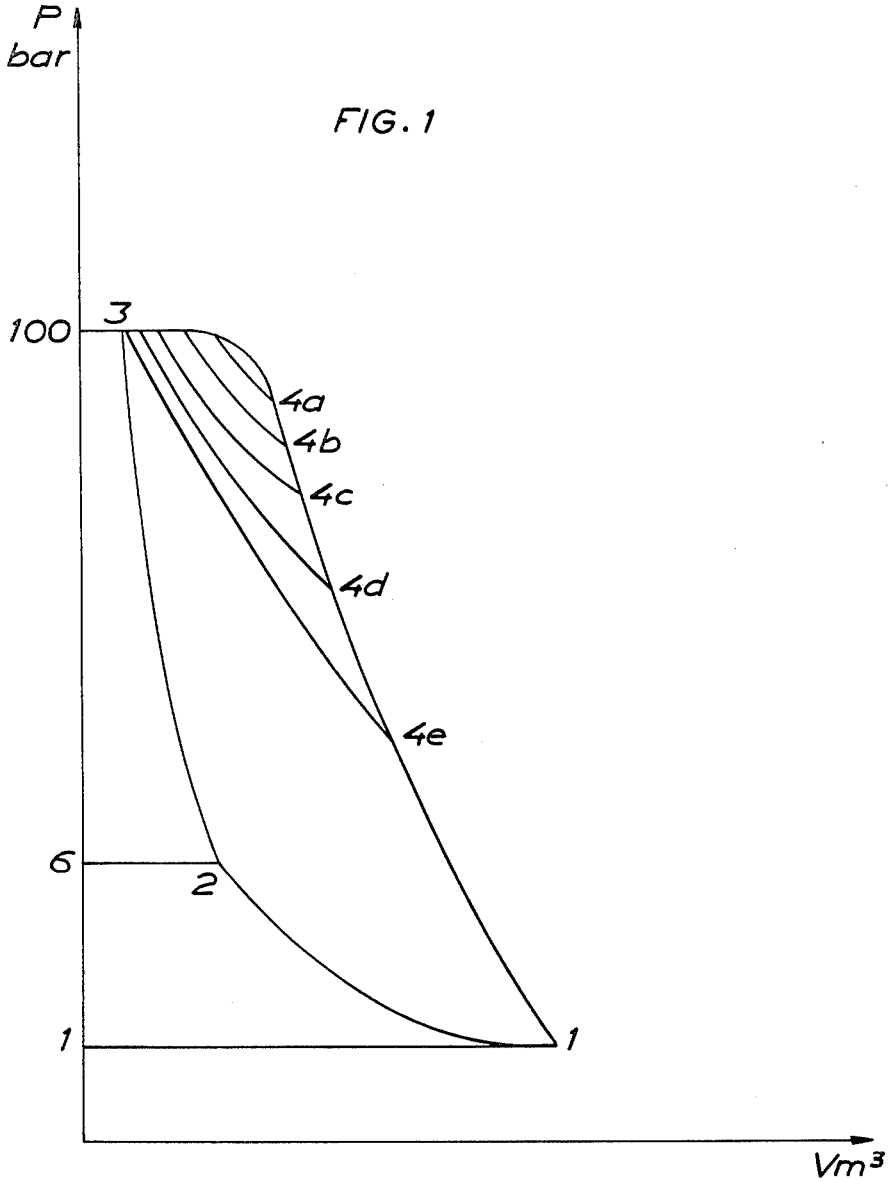
FIG. 1 represents the thermodynamic process.

In the process illustrated in FIG. 1 use is made of a rare gas e.g. argon, as a working medium in the heat engine, the H-value of the rare gas being approximately equal to 1.66. To the rare gas there is added aqueous steam having a H-value approximately equal to the 1.30. As the aqueous steam thus has a H-value lower than that of the rare gas, the rare gas will obtain the condensation heat, which correponds to the steam forming heat, from the aqueous steam during the expansion of the rare gas.

Isothermal compression of the rare gas takes place between 1–2. The isothermal compression is brought about by injection of liquid which is allowed to carry off heat. Isentropic (adiabatic) compression of the rare gas takes place between 2–3. Injection of aqueous steam into the rare gas takes place between 3–4. The supply of heat thus starts here at the same time as the expansion. Between 4–1 the expansion continues at the same time as the aqueous steam condenses, and practically all the steam should have condensed into liquid at point 1. Thus, one should not supply more aqueous steam than what is condensed during the expansion. In connection with the condensation of the aqueous steam, the rare gas receives the condensation heat.

The zone represented by surface 3, 4*a*, 4*b*, 4*c*, 4*d* and 4*e* constitutes the control zone at constant vapour pressure.

In the example shown the pressure at the point designated 1 is 1 bar, at the point designated 2 it is 6 bar and at the point designated 3 it is 100 bar.

The vapour, which is supplied at 100 bar, should preferably be superheated at about 800° C., the thermal efficiency being about 75%.

It would also be possible to carry out the process by using air or nitrogen as a working medium which has a H-value approximately equal to 1.40. The heat, however, which in this connection passes from the condensed aqueous steam, will be very insignificant, and therefore the process can hardly be considered economically practicable, at least not under present conditions.

Figure 2:
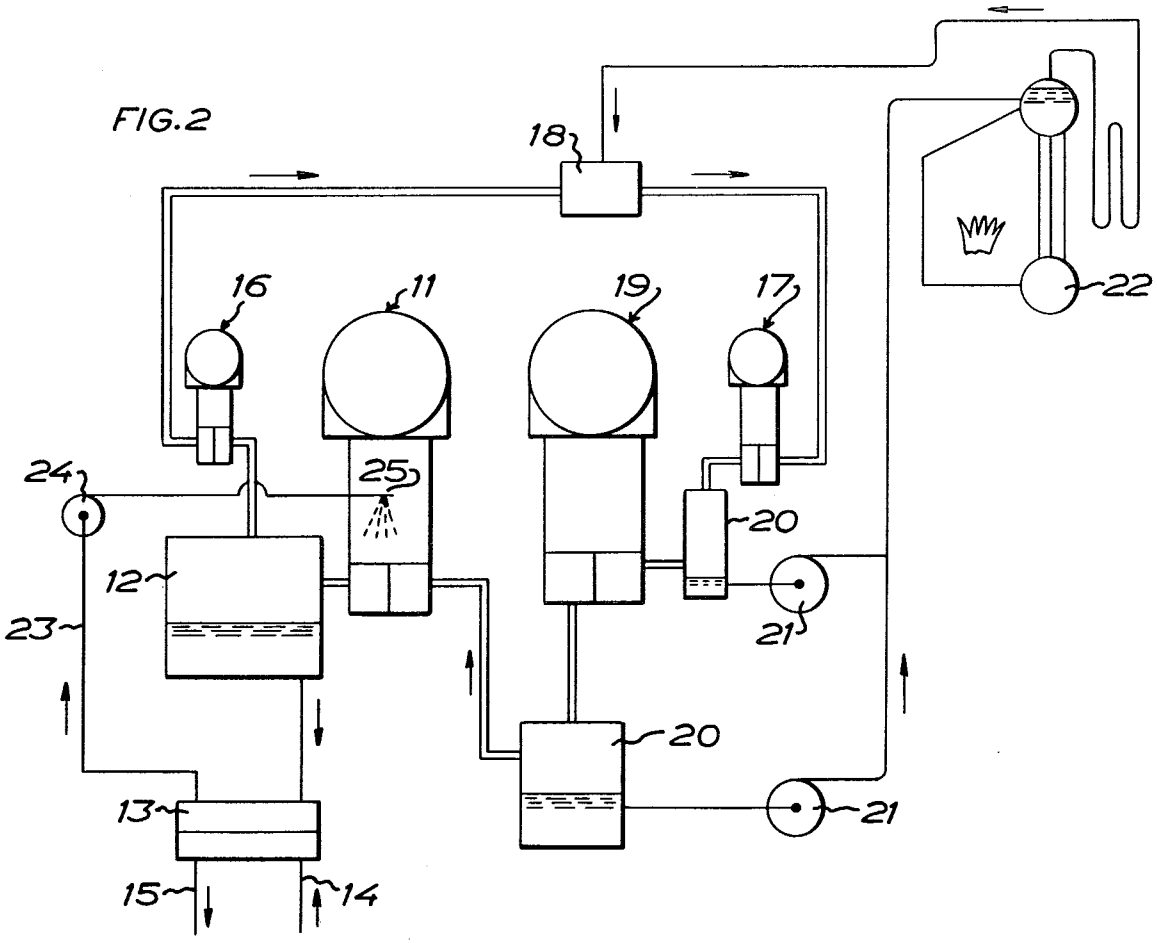
FIG. 2 shows schematically the engine for carrying out the process of the invention.

The engine schematically illustrated in FIG. 2 is provided with an isothermal compressor 11 into which liquid is injected during the compression. Heat will thereby be carried off. The gas from the isothermal compressor 11 is to pass a liquid separator 12 in which the gas will be freed from liquid drops. In a counter-current type heat exchanger, designated 13, the heat received from the isothermal compression is transferred to the ambient air or water, e.g. through the radiator of an automobile or boat. The inlet conduit of the heat exchanger 13 is designated 14 and the outlet conduit 15.

The gas thus freed from liquid drops is transferred to the isentropic compressor 16 which may be a piston, lamella or turbo type compressor.

Interposed between the isentropic compressor 16 and the expansion machine 17, which may be a piston, lamella or turbine type machine, is a gas-vapour mixer 18. Alternatively, the vapour may be mixed with the gas within the expansion machine 17.

The second step of the expansion machine is designated 19. Additional steps may of course also be provided. The expansion machine 19 is connected to a liquid separator 20 for the condensate which is to be pumped by the condensate pump 21 to the steam-boiler 22 with superheater. Also between the expansion machines 17 and 19 there should be a drop or liquid separator 20 with a pump 21 for pumping the condensate to the steam-boiler 22. Operation with solar energy and nuclear force is possible in connection with the steam-boiler 22.

A liquid conduit 23 to the isothermal compressor 11 is provided with a liquid injection pump 24 and terminates in a liquid injection nozzle 25 for the liquid. The nozzle 25 is preferably engaged in the downwardly directed piston of the compressor 11, said piston being positioned under the crankshaft to make it easy for the liquid to leave the compressor.

In case the condensate is not completely separated from the gas in the separator 20 it is separated from the gas in the isothermal compressor 11.

The step between 1–2 in FIG. 1 is taken in the isothermal compressor 11, the step between 2–3 is taken in the isentropic compressor 16, the step between 3–4 is taken in the expansion machine 17 and the step between 4–1 is taken in the expansion machine 19.

The installation described above may also be used for desalting of sea water. In that case the steam-boiler 22 is fed with salt water. The fresh water is taken out at the water separator 20, while the rare gas, preferably argon, must be recovered from the fresh water. The pressure in the boiler 22 should be kept relatively low in the preparation of fresh water because otherwise there will be a hard scale in the boiler.

According to a modified embodiment the isothermal compressor 11 may be replaced by several common compressors of the piston, lamella or turbo type with intermediate coolers. This, however, reduces the efficiency.

The invention is not restricted to that which is described above and shown in the drawings but may be modified within the scope of the appended claims.

I claim and desire to secure by Letters Patent is:

1. A process for the recovery of mechanical work in a heat engine, comprising using as a working medium in the heat engine a gas to which vapour is added having a H-value lower than the value of the gas, the gas being caused to absorb the condensation heat from the vapour by condensation of the vapour under essentially isothermal expansion wherein rare gas, from the group including argon and helium, is used as a working medium in the heat engine.

2. A process as claimed in claim 1, wherein the vapour supplied is aqueous steam which is superheated.

3. A process as claimed in claim 1, which is carried out in a compression and expansion engine, the vapour being added at least during the expansion phase.

4. A process as claimed in claim 3, wherein substantially all the vapour is condensed into liquid during the expansion phase.

5. A process as claimed in claim 3, wherein the compression of the gas in the engine is carried out in at least two steps, the first step being essentially isothermal and the latter step essentially isentropic, and the expansion of the gas in the engine is also carried out in at least two steps, the first step being essentially isothermal and the latter step essentially isentropic.

6. A process as claimed in claim 5, wherein liquid is injected into the gas during the compression at the first step for carrying off heat.

7. An engine for carrying out the process of claim 5, in which the compression of the gas in the engine is performed in at least two steps, the first step being essentially isothermal and the latter essentially isentropic, and in which the expansion of the gas in the engine is also carried out in at least two steps, the first step being essentially isothermal and the latter essentially isentropic, wherein said engine comprises; an isothermal compressor to which a liquid injection mechanism or the like is connected; an isentropic compressor; an expansion machine to which a vapour generator is connected; and at least one additional expansion machine with liquid separator for the condensed vapour; said compressors and expansion machines being included in a closed circulation system for the gas.

8. A process for the recovery of mechanical work in a heat engine, comprising using as a working medium in the heat engine a gas to which zinc vapour is added having a H-value lower than the value of the gas, the gas being caused to absorb the condensation heat from the zinc vapour by condensation of the zinc vapour under essentially isothermal expansion.

9. A process for the recovery of mechanical work in a heat engine, comprising using as a working medium in the heat engine a gas to which cadmium vapour is added having a H-value lower than the value of the gas, the gas being caused to absorb the condensation heat from the cadmium vapour by condensation of the cadmium vapour under essentially isothermal expansion.

* * * * *